US006357375B1

(12) United States Patent
Ellis

(10) Patent No.: US 6,357,375 B1
(45) Date of Patent: Mar. 19, 2002

(54) BOAT THRUSTER CONTROL APPARATUS

(76) Inventor: Donald Ray Ellis, 265 Seawall Rd., Southwest Harbor, ME (US) 04679

( * ) Notice: Subject to any disclaimer, the term of this patent is extended or adjusted under 35 U.S.C. 154(b) by 0 days.

(21) Appl. No.: 09/723,006

(22) Filed: Nov. 27, 2000

(51) Int. Cl.[7] ..... B63H 25/00
(52) U.S. Cl. ..... 114/144 R; 114/144 RE
(58) Field of Search ..... 114/144 R, 144 RE, 114/144 E; 701/21; 74/450 B; 244/234, 237

(56) References Cited

U.S. PATENT DOCUMENTS

| | | | | | |
|---|---|---|---|---|---|
| 3,198,158 | A | | 8/1965 | Winter | |
| 3,865,067 | A | | 2/1975 | Archer | |
| 3,911,851 | A | | 10/1975 | Canazzi | |
| 4,216,467 | A | * | 8/1980 | Colston | 340/365 L |
| 4,691,659 | A | * | 9/1987 | Ito et al. | 114/144 R |
| 4,962,717 | A | * | 10/1990 | Tsumiyama. | 114/144 R |
| 5,090,929 | A | | 2/1992 | Rieben | |
| 5,129,846 | A | | 7/1992 | Dimijian | |
| 5,140,926 | A | | 8/1992 | Denston | |
| 5,605,480 | A | | 2/1997 | Wright | |
| 6,009,822 | A | | 1/2000 | Aron | |
| 6,234,100 | B1 | * | 5/2001 | Fadeley et al. | 114/144 R |
| 6,234,853 | B1 | * | 5/2001 | Lanyi et al. | 440/53 |
| 6,308,651 | B2 | * | 10/2001 | McKenney et al. | 114/144 R |

OTHER PUBLICATIONS

"Total Control," by Charles Barthold. JetStick Magazine review, reprinted with permission from Yachting Magazine.

* cited by examiner

*Primary Examiner*—S. Joseph Morano
*Assistant Examiner*—Ajay Vasudeva
(74) *Attorney, Agent, or Firm*—Thomas L. Bohan; Patricia M. Mathers

(57) ABSTRACT

Apparatus for controlling thrusters in small water craft. A water craft is provided with a bow thruster and a stern thruster. A control panel in the helm has a thruster control stick for controlling each thruster and a HOLD device associated with each control stick. When the boat is brought into the desired position, for example, alongside a dock, the HOLD device can be pushed for one or both of the thrusters. When the HOLD is pushed, a signal is sent to a CPU to ignore any changes in position of the corresponding thruster control stick and to maintain the current amount of thrust in the corresponding thruster. In an alternative embodiment, a fore-and-aft thruster is provided as a third thruster, in addition to the bow and stern thruster. This fore-and-aft thruster is controlled analogously to the control of the other two thrusters, and is used to maneuver the boat forward and backward. Furthermore, one of the thruster control sticks can be a double-axis control stick, so that only two sticks are needed to control the three thrusters. Each thruster can be connected with an on-board generator and used as a "come-home" engine in the case of main propulsion engine failure.

11 Claims, 5 Drawing Sheets

BOAT THRUSTER CONTROL APPARATUS

BACKGROUND INFORMATION

1. Field of the Invention

The invention relates to bow and/or stern thrusters on water craft. More particularly, the invention relates to bow/stern thruster control apparatus. More particularly yet, the invention relates to such apparatus for small water craft.

2. Description of the Prior Art

Thruster propulsion systems for water craft are well-known, although most such systems are designed for large vessels. Thrusters operate by drawing water through a channel and expelling it in a particular direction. The force of the expulsion of the water creates a reactive force that moves the boat in a direction opposite to the direction of the water expulsion. The use of bow and/or stern thrusters improves the maneuverability of a boat by allowing the boat to move in a direction lateral to the normal travel direction of the boat, thereby making it easier to turn the boat or to position it alongside a dock. This increased maneuverability makes it much easier, for example, to maneuver boats in crowded marinas or to bring a boat sideways up to a dock to tie up or load/unload goods. Typically, if a boat is equipped with a bow thruster and a stern thruster, the thrusters can be operated singularly or simultaneously. One such conventional thruster is disclosed in U.S. Pat. No. 6,009,822 (Aron; issued Jan. 4, 2000). In place of, or in addition to a bow and/or stern thruster, some water craft have a fore-and-aft thruster, which provides greater control over thrust in the fore-and-aft direction than does the main propulsion engine.

The action of the thruster is generally controlled by a stick on a control panel located at the helm of the boat. The stick is typically a joystick or swivel stick that has movement about a single axis or a double axis. The position of the stick controls the opening and closing of a valve, which, in turn, controls the amount of thrust generated by the thruster. The Hinckley Boat Co., for example, uses a double-axis swivel-stick as a control stick for a bow thruster. As with conventional thruster joysticks, this swivel-stick is spring-loaded, so that it returns to a helm neutral position when the operator lets go of it. This is often a disadvantage, particularly with small water craft in which there is often only one person to operate the boat and to secure it alongside a dock. When the operator lets go of the stick to secure the boat, the stick snaps back to the helm neutral position, and the boat veers away from the desired position. As a result, the automatic return of the control stick to the neutral position makes it difficult, for example, for the operator to tie up alongside the dock or to turn to some other task that requires the boat to stay in a particular position, such as alongside the dock.

One way of solving this problem is to construct a joystick that does not return to the neutral position. For example, it is conceivable to construct a thruster control in which preset valve positions, such as ¼ open, ½ open, or wide open, can be selected. The disadvantage of this solution is that it would require a number of metering valves and thus would result in a system that is very expensive.

What is needed, therefore, is inexpensive thruster control apparatus that will allow a boat operator to operate a bow and/or stern thruster on a boat to maneuver the boat, including moving it sideways or rotating it about its longitudinal axis, and bring to it into position alongside a dock. What is further needed is such apparatus that would allow the operator to lock the operation of the thrusters into position in order to maintain the position of the boat alongside a dock, without having to maintain physical control of the thruster control. What is yet further needed is such apparatus that would include a fore-and-aft thruster and could be used as a come-home engine in case of main propulsion engine failure.

SUMMARY OF THE INVENTION

For the above-cited reasons, it is an object of the present invention to provide an inexpensive thruster control apparatus that will enable the operator of a boat to maneuver the boat into position along side a dock. It is a further object of the invention to provide such apparatus that will allow the thruster controls to be locked into position so as to maintain a docking position of the boat while the operator physically releases the thruster controls. It is a yet further object to provide such apparatus that has a fore-and-aft thruster and further, that can be used as a comehome engine.

The objects are achieved by providing thruster control apparatus that provides a control stick and a "HOLD" switch for controlling each thruster. The thrusters used are conventional thrusters, such as a motor mounted above a shifter that runs a 90° gear box. In the Preferred Embodiment, the thrusters are operated by a hydraulic pump system, although other operating systems such as an electrically-operated or pneumatically-operated systems are also possible.

In a first embodiment of the invention, the apparatus provides a thruster control panel in the helm of the boat. The control panel has two single-axis control joysticks, a HOLD button associated with each joystick, an ON button, and an OFF button. The ON/OFF buttons are push-on/push-off buttons that are used to turn the pump operating system on and off. The joysticks and buttons are electrically connected with a central processing unit (CPU) that is powered by 24 V DC. The CPU electrically actuates a hydraulic valve that controls the amount of thrust from the stem thruster and/or a hydraulic valve that controls the amount of thrust from the bow thruster. The amount of thrust is initially proportional to the position of the respective thruster joystick. The bow and stem thrusters are conventional athwart-ship-thrusters, such as thrusters that are arranged athwart-ship in a tunnel that extends through the stem or stern, or retractable LEWMAR thrusters that drop down into the water.

The operating system is switched on when the ON button is actuated. The amount offlow of fluid pumped by the operating system through a thruster valve determines the amount of thrust generated by the respective thruster. In normal operation, the thruster valve opens or closes proportionally to a displacement of the control stick that is associated with that particular thruster valve. When the associated HOLD button is actuated, however, the apparatus according to the invention sends an electrical signal to the CPU to ignore any change in position of the joystick and to maintain the same amount of flow of operating fluid through the valve, i.e., to maintain the same amount of thrust generated by the thrusters. Accordingly, once the HOLD button is actuated, the joystick may snap back to a neutral position after the operator releases it without influencing the open position of the thruster valve. Instead, the valve holds the same open state it had when the HOLD button was set to the ON position. In this way, the same amount of thrust is maintained through the respective thruster that was being provided when the HOLD button was set to the ON position.

In the Preferred Embodiment, the apparatus provides control of a third thruster, in addition to the stern and bow thrusters of the first embodiment. In this Preferred Embodiment, the joystick that controls the stern thruster is a double-axis joystick that is also connected with a third thruster, a fore-and-aft thruster. The fore-and-aft thruster provides a thrust that propels the boat in the fore or aft direction. When the double-axis stick is moved in the port or starboard direction, the stern thruster is controlled; when moved in the fore or aft direction, the fore-and-aft thruster is controlled. Accordingly, two HOLD buttons are provided for this joystick—one for each of the two thrusters controlled by the stick. In an alternative embodiment, single-axis control sticks and two HOLD buttons are provided to control respectively the second and third thrusters.

In all embodiments, the thrusters can be connected to the on-board generator and be used as a "come-home" engine in the case of failure of the main propulsion engine.

DETAILED DESCRIPTION OF THE INVENTION

Figure 1:
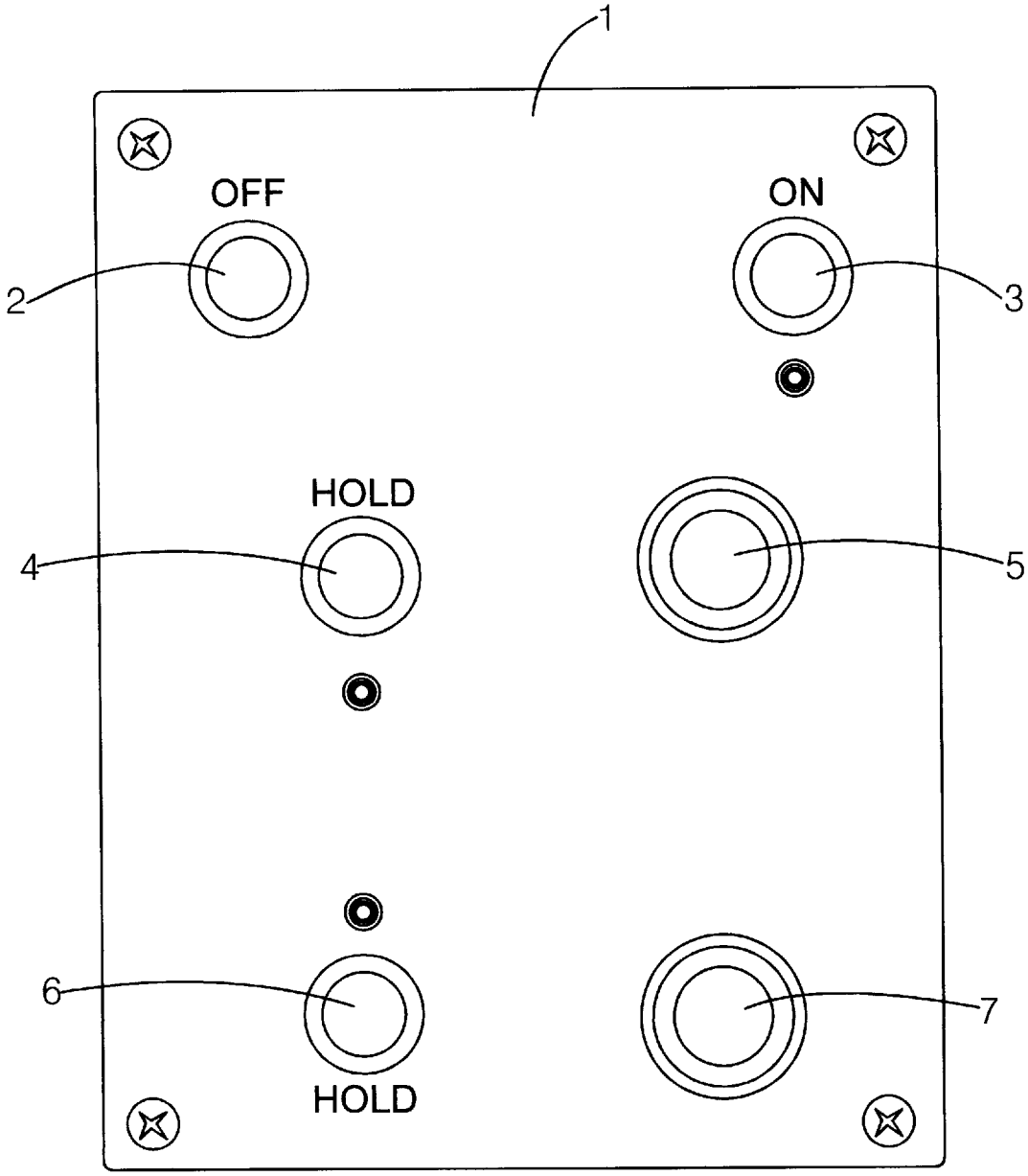
FIG. 1 is a plane view of a control panel for the thruster control apparatus of the first embodiment of the invention.

FIG. 1 shows a control panel 1 for a boat thruster control apparatus comprising two thrusters, according to a first embodiment of the invention. The panel 1 contains an ON button 3, an OFF button 2, a first thruster control stick 5 and a first HOLD button 4 associated with the first thruster control stick 5, and a second thruster control stick 7 and a second HOLD button 6 associated with the second thruster control stick 7.

Figure 2:
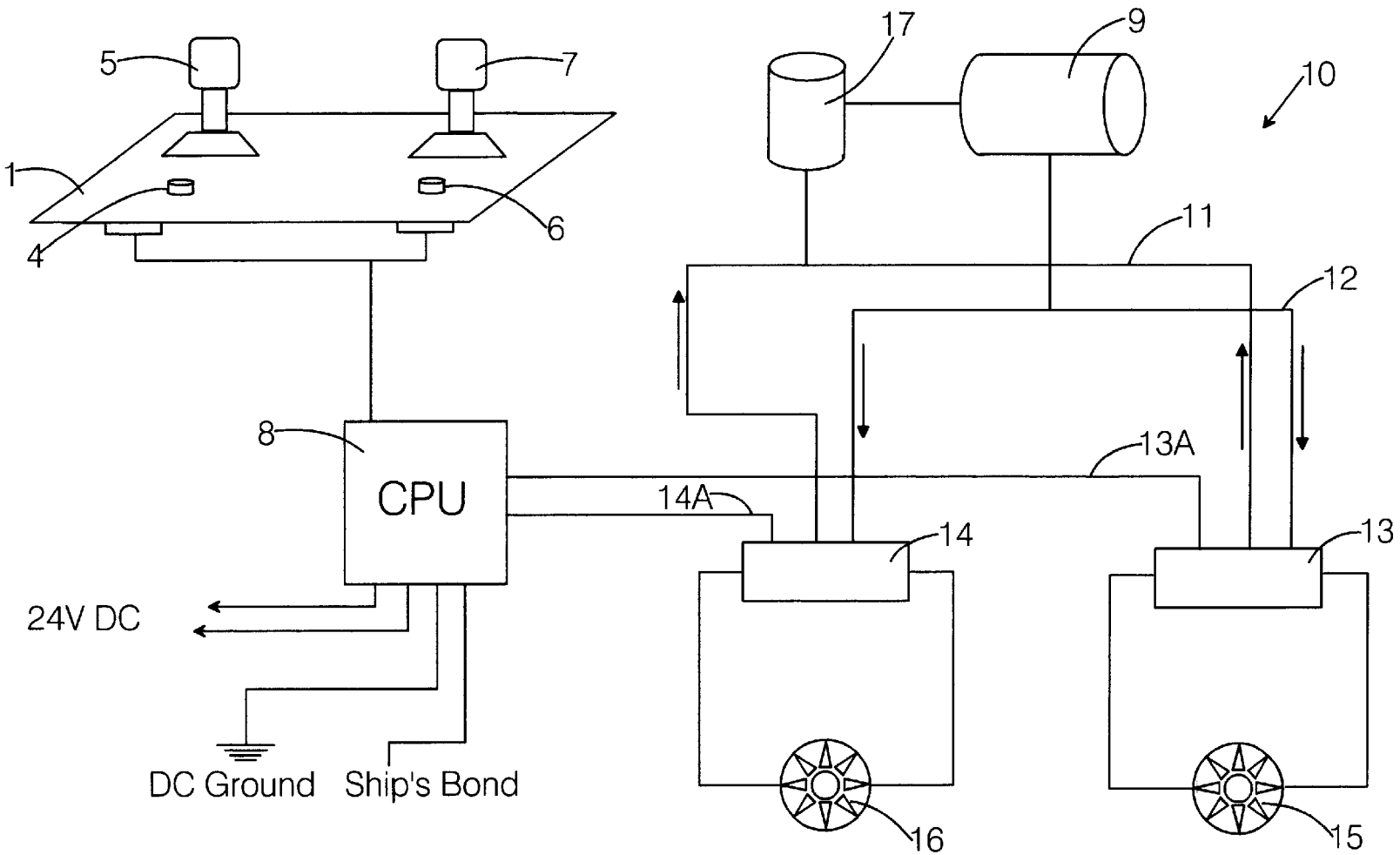
FIG. 2 is a schematic diagram of the thruster control apparatus according to the first embodiment of the invention.

FIG. 2 is a schematic diagram of the first embodiment of a control thruster device 10. A stem thruster 16 and a bow thruster 15 are connected to a conventional hydraulic system comprising an hydraulic pump 9, an hydraulic return tank 17, a feed line 12, a return line 11, an electronic-hydraulic stern thruster valve 14 and an electronic-hydraulic bow thruster valve 13.

The stern thruster 16 and bow thruster 15 are athwart-ship thrusters and may be any one of a number of conventional thrusters suitable for small water craft, such as tunnel-encased thrusters built into the bow or stern of the water craft, or retractable thrusters, such as the LEWMAR thruster, that drop down into the water for operation. A central processing unit (CPU) 8 is connected on one side with the bow-thruster valve 13 and the stern-thruster valve 14 by respective input lines 13A, 14A and on the other side with the control panel 1. The CPU 8 is also connected to a 24 Volt DC power supply (not shown). The valves of the embodiments of the invention are linear, electronically-controlled hydraulic valves that, during normal operation of the control stick, open and close proportional to the displacement of the respective control stick.

Figure 5:
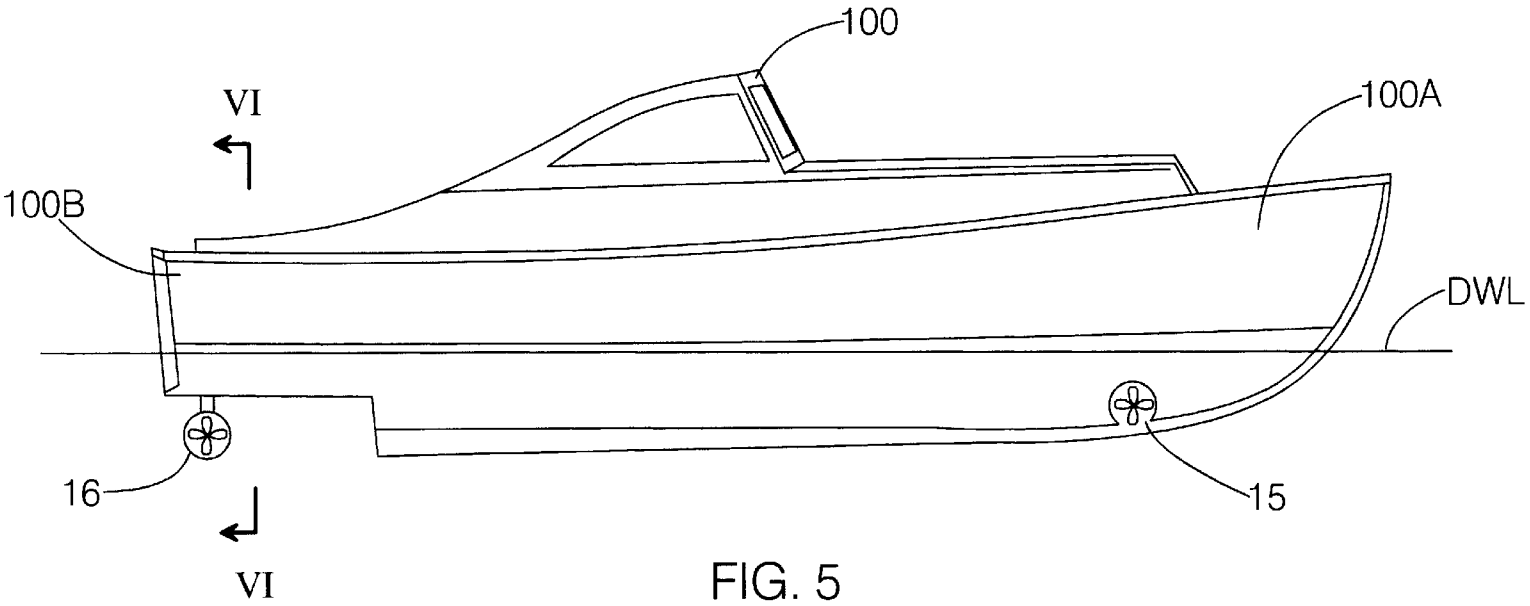
FIG. 5 illustrates the approximate location of the bow and stem thrusters according to the embodiments of the invention.

FIG. 5 illustrates the approximate location of the bow and stem thrusters in a small water craft 100 according to the first embodiment. The direction of thrust from the first thruster 15 and the second thruster 16 is in a direction approximately perpendicular to the plane of the drawing sheet. In the Embodiments as shown in FIG. 5, the bow thruster 15 is arranged in a tunnel that extends athwart the water craft 100 through the stem 100A of the boat. The stern thruster 16 is a retractable thruster that is dropped down to operating level in the stern 100B of the water craft 100.

Figure 3:
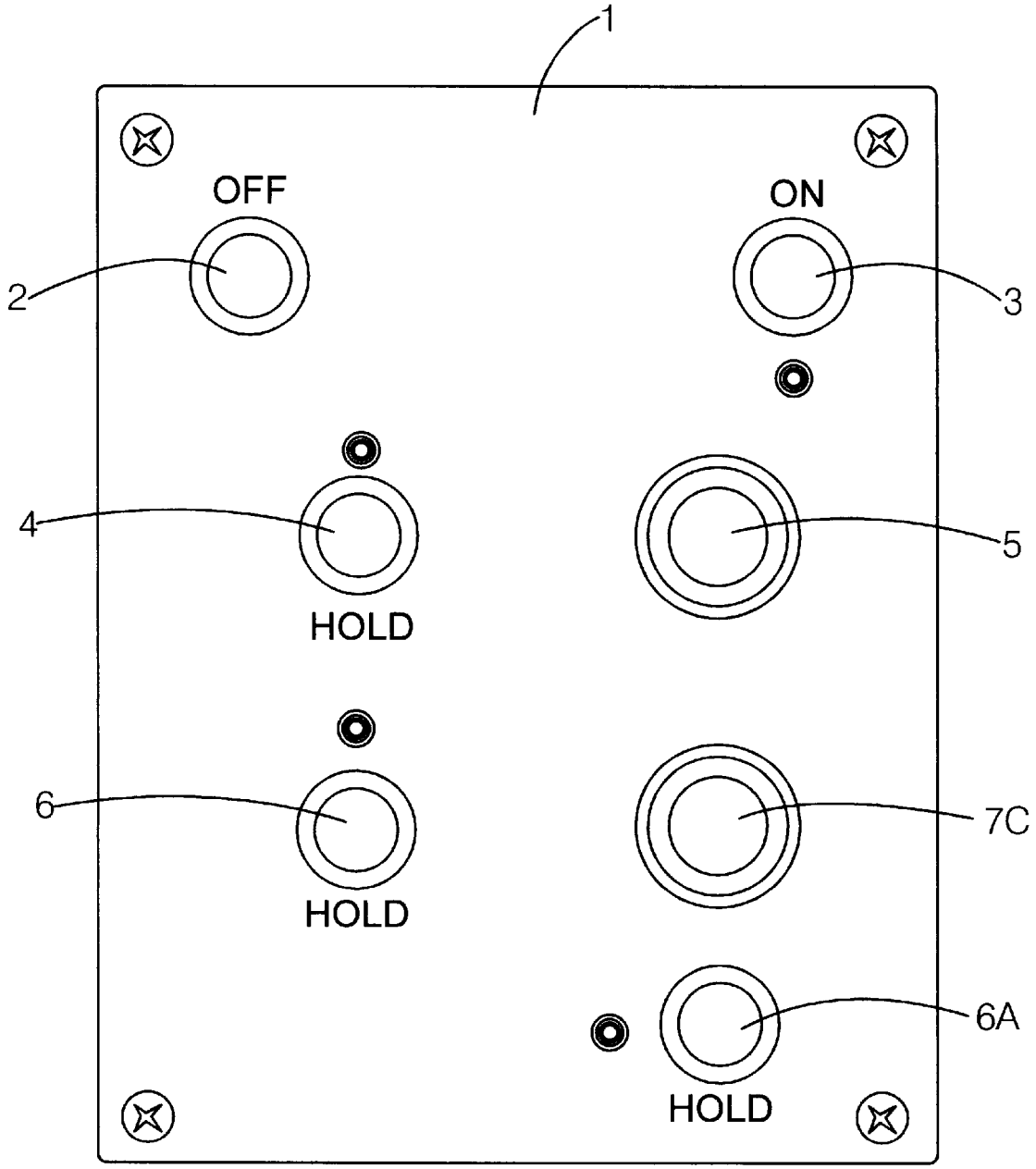
FIG. 3 is a plane view of a control panel for the thruster control apparatus of the Preferred Embodiment of the invention.
Figure 4:
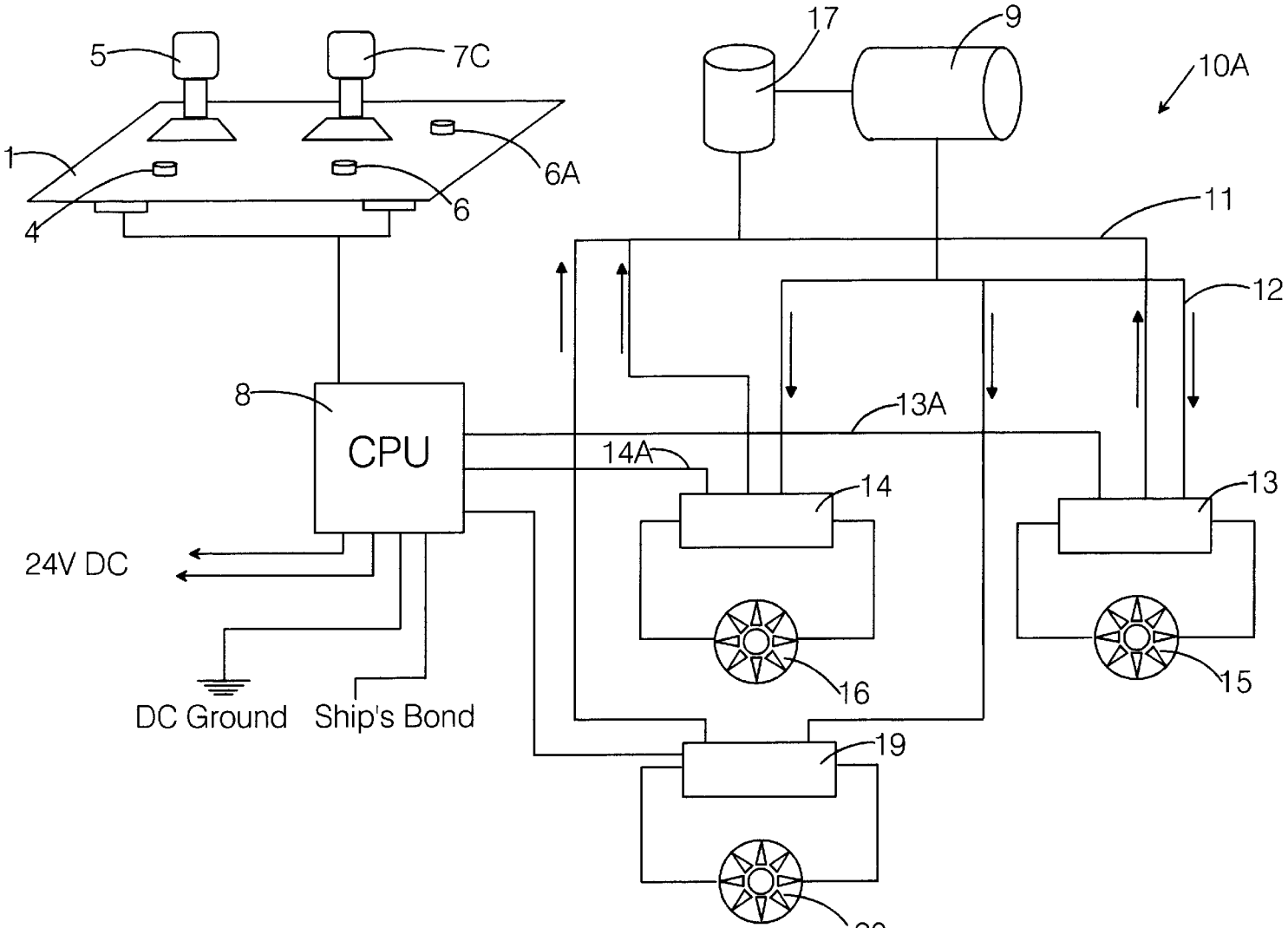
FIG. 4 is a schematic diagram of the thruster control apparatus according to the Preferred Embodiment of the invention.

FIGS. 3 and 4 illustrate the Preferred Embodiment of the invention, an advanced thruster control system 1 OA that includes a third thruster 20 that is a fore-and-aft thruster, along with a fore-and-aft thruster HOLD button 22 provided on the control panel 1. This third thruster 21 is controlled by a second thruster control stick 7C, which in this Preferred Embodiment is a double-axis joystick. The components of the control system 10A that are identical with those of 10 have the same reference number. In an alternative to the Preferred Embodiment, the second control stick 7D is used for the stern thruster and a third single-axis control stick is used to control the fore-and-aft thruster. Each control stick 5, 7, and 7D is provided with a separate HOLD button 4, 6, and 22 respectively.

Figure 6:
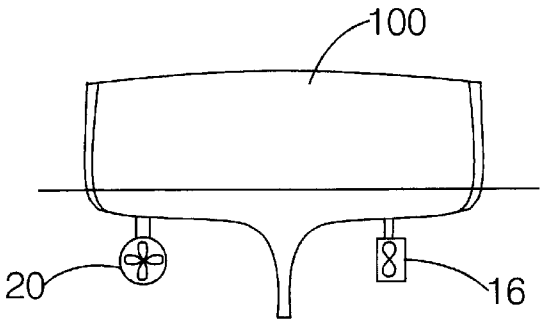
FIG. 6 illustrates the location of the fore-and-aft thruster in the Preferred Embodiment of the invention.

FIG. 6 shows the approximate location of the fore-and-aft thruster 20. This thruster 20 is also a retractable thruster in the Preferred Embodiment, and is dropped in the stern 100B area to an operating level beneath the hull of the water craft 100. The direction of thrust from this third thruster 20 is again in a direction approximately perpendicular to the plane of the drawing sheet.

The first embodiment and the Preferred Embodiment of the invention provide the water craft 100 with two modes of thruster operation. In the first mode, when manipulating the control sticks 5 and/or 7, the corresponding hydraulic valves 13 and/or 14 open or close to an extent proportional to the displacement of the respective control stick from its neutral position. In the first embodiment of the thruster control system 10, the control sticks 5 and 7 are single-axis joysticks and can be moved either in the port/starboard or the fore/aft directions, depending on the type of stick used. In the second mode of operation, actuating one or both of the HOLD buttons 4, 6 will cause the thruster control system 10 to override the position of the respective control stick 5, 7, for example, and to maintain an amount of flow of operating fluid through the respective thruster valves 13, 14 that is the same as the amount of flow that was flowing through the valve when the HOLD button was pushed. Thus, to maneuver the water craft 100 alongside a dock, for example, the operator manipulates one or both of the control sticks 5 and 7 to provide a port or starboard thrust to the bow and/or stern of the water craft 100, as the situation requires. When the water craft 100 is in the desired or approximately desired position, the operator then pushes the first HOLD button 4 and/or second HOLD button 6 to the ON position. In all embodiments of the invention, the two HOLD buttons 4, 6 are push-on/push-off switches. When the HOLD button is pushed ON, a signal is sent to the CPU 8 to maintain the current valve position, and to ignore any change in the position of the control stick. Thus, if the control stick is a spring-loaded stick that snaps back to a neutral position, it can move to the neutral position without influencing the amount of thrust being generated by the particular thruster that is associated with the HOLD button. As a result, the operator can now release his or her hold of the respective control stick and the amount of thrust from the thruster for which the HOLD button has been pushed ON will be maintained. The operator may then, if necessary, continue to maneuver the water craft 100 into a final position using the other thruster. When the second HOLD button 6 is pressed, the amount of thrust from that second thruster 7 will also be maintained. This enables the operator to release manual control of the first and second control sticks 5 and 7 and turn to other tasks, while maintaining a steady, unchanging thrust from one or more thrusters, as a means of holding the boat in a certain position, for example, alongside a dock.

Operation of the Preferred Embodiment of the thruster control system 1OA is similar to operation of the first embodiment, with the exception that the second control stick 7C is a double-axis control stick that is not only connected with the second thruster 16, but also with a third thruster 20 by means of a third valve 19. A second HOLD button 6 is associated with the second thruster 16 and a third HOLD button 6A is associated with the third thruster 20. By manipulating the second control stick 7C along the port/starboard axis, operation of the second thruster 16 is the same as described in the first embodiment of the invention, and, accordingly, the amount of thrust being generated by the second thruster 16 can be set by pressing the second HOLD button 6. The third thruster 20 is controlled by manipulating the stick 7C about the fore/aft axis, and the amount of thrust through the third thruster 20 can be set by pressing the third HOLD button 6A. Having this third thruster 20 allows the operator to maneuver the water craft 100 fore and aft, with a more controllable thrust than with the main propulsion engine.

With the first embodiment of the thruster control system 10, the thrusters 15 and 16, and with the Preferred Embodiment 1OA, the thrusters 15, 16, and 20, can be connected with an on-board generator and can be used as an emergency "come-home" engine in the case of main engine failure. The Preferred Embodiment, because of the third thruster 20 that is a fore-and-aft thruster, will provide better emergency steering means if the steering is jammed.

The embodiments mentioned herein are merely illustrative of the present invention. It should be understood that variations in construction and installation of the present invention may be contemplated in view of the following claims without straying from the intended scope and field of the invention herein disclosed.

What is claimed is:

1. A Apparatus for controlling thrust on a water craft, said water craft being equipped with a thruster operating system for pumping operating fluid, a thruster control stick, and a thruster array that includes a thruster and a thruster valve, wherein a change in position of said thruster control stick determines flow rate of said operating fluid through said thruster valve, and wherein said rate determines thrust magnitude being generated by said thruster, said apparatus comprising:

a central processing unit (CPU) and an actuatable thruster HOLD unit associated with said thruster control stick, wherein said CPU is electrically connected on an output side to said thruster valve and electrically connected on an input side to said HOLD unit;

wherein said apparatus is configured such that when said HOLD unit is actuated a HOLD-signal is sent to said CPU commanding said CPU to ignore changes in position of said thruster control stick and commanding said CPU to maintain an unchanging level of said flow rate through said thruster valve.

2. The apparatus for controlling thrust on a water craft as described in claim 1, wherein said HOLD unit comprises a first HOLD device, said thruster array comprises a first thruster array having a first thruster and a first thruster valve, and said thruster control stick comprises a first thruster control stick, said apparatus further comprising:

a second thruster array that includes a second thruster valve and a second thruster;

a second actuatable thruster HOLD device; and a second thruster control stick;

wherein said cpu (CPU) is electrically connected on said output side to a first thruster valve and said second thruster valve, and is connected on said input side to a first thruster HOLD device associated with said first thruster control stick and said second thruster HOLD device associated with said second thruster control stick;

wherein a flow rate through said first thruster valve is controllable by a displacement of said first thruster control stick and said flow rate through said first thruster valve determines a thrust magnitude generated by said first thruster;

wherein a flow rate through said second thruster valve is controllable by a displacement of said second thruster control stick and wherein said flow rate through said second thruster valve determines a thrust magnitude generated by said second thruster, wherein said apparatus is configured such that when said first thruster HOLD device is actuated a first HOLD signal is sent to said CPU commanding said CPU to ignore changes in position of said first thruster control stick and commanding said CPU to maintain an unchanging level of said flow rate through said first thruster valve, and when said second thruster HOLD device is actuated a second HOLD signal to sent to said CPU commanding said CPU to ignore changes in position of said second thruster control stick and commanding said CPU to maintain an unchanging level of said flow rate through said second thruster valve.

3. The apparatus for controlling thrust on a water craft as described in claim 2, wherein said second thruster control stick is a double-axis thruster control stick, said apparatus further comprising:

a third thruster array having a third thruster and a third thruster valve; and a third HOLD device that is associated with said third thruster;

wherein a second double-axis thruster control stick has a first axis and a second axis and said second HOLD device is associated with said first axis of said second thruster control stick and said third HOLD device is associated with said second axis of said second thruster control stick;

wherein changes in position of said first axis of said second double-axis thruster control stick controls a flow rate through said second thruster valve and changes in position of said second axis of said double-axis thruster control stick control a flow rate through said third thruster valve; and wherein actuating said first HOLD device sends a first signal to said CPU commanding said CPU to ignore changes in position of said first thruster control stick and commanding said CPU to maintain an unchanging level of said flow rate of through said first thruster valve, and actuating said second HOLD device sends a second signal to said CPU commanding said CPU to ignore changes in position of said first axis of said second thruster control stick and commanding said CPU to maintain an unchanging level of said flow rate through said second thruster valve, and actuating said third HOLD device sends a third signal to said CPU commanding said CPU to ignore changes in position of said second axis of said second thruster control stick and commanding said CPU to maintain an unchanging level of said flow rate through said third thruster valve.

4. The apparatus for controlling thrust on a water craft as described in claim 3, wherein said first thruster is a bow thruster, said second thruster is a stern thruster, and said third thruster is a fore-and-aft thruster.

5. The apparatus for controlling thrust on a water craft as described in claim 1, wherein said actuatable thruster HOLD unit comprises a first thruster HOLD device, said thruster control stick comprises a double-axis thruster control stick having a first axis and a second axis, and said thruster array comprises a first thruster array having a first thruster and a first thruster valve, said apparatus further comprising:

a second thruster array that includes a second thruster valve and a second thruster; and an actuatable second thruster HOLD device;

wherein said cpu (CPU) is electrically connected on said output side to said first thruster valve and said second thruster valve, and is connected on said input side to a first thruster HOLD device and said second thruster HOLD device;

wherein a flow rate through said first thruster valve is controllable by a displacement of said thruster control stick about a first axis and said flow rate through said first thruster valve controls a thrust magnitude generated by said first thruster;

wherein a flow rate through said second thruster valve is controllable by a displacement of said thruster control stick about a second axis, and said flow rate through said second thruster valve controls a thrust magnitude generated by said second thruster; and wherein said apparatus is configured such that when said first HOLD device is actuated a first HOLD signal is sent to said CPU commanding said CPU to ignore changes in position of said thruster control stick about said first axis and commanding said CPU to maintain an unchanging level of said flow rate through said first thruster valve, and when said second HOLD device is actuated a second HOLD signal is sent to said CPU commanding said CPU to ignore changes in position of said thruster control stick about said second axis and commanding said CPU to maintain an unchanging level of said flow rate through said second thruster valve.

6. The apparatus for controlling a thruster on a water craft as described in claim 1, wherein said water craft has a tunnel that extends athwart-ship and said thruster is encased in said tunnel.

7. The apparatus for controlling a thruster on a water craft as described in claim 1, wherein a water craft has a hull and said thruster is a retractable thruster that is suspended beneath said hull.

8. The apparatus for controlling a thruster on a water craft as described in claim 1, wherein said thruster valve is an electrically-controlled linear valve.

9. The apparatus for controlling a thruster on a water craft as described in claim 1, wherein said operating system is a hydraulic system.

10. The apparatus for controlling thrust on a water craft as described in claim 1, further comprising a control panel, an ON switch, and an OFF switch, wherein said water craft has a helm and said control panel is adoptable to be mounted in said helm, and wherein said HOLD device and said thruster control stick and said ON switch and said OFF switch are mounted on said control panel, and wherein said operating system is turned on and off by actuating said respective ON switch and said OFF switch.

11. The apparatus for controlling thrust on a water craft as described in claim 1, wherein said ON switch and said OFF switch are push-on/push-off switches.

* * * * *